US006008572A

United States Patent [19]

Van Laarhoven et al.

[11] Patent Number: 6,008,572

[45] Date of Patent: Dec. 28, 1999

[54] DISPLAY DEVICE, A CONNECTION ELEMENT FOR USE IN SAID DISPLAY DEVICE, AND A STRIP PROVIDED WITH SUCH CONNECTION ELEMENTS

[75] Inventors: Franciscus M. H. Van Laarhoven; Cornelis Peters; Theunis S. Baller, all of Eindhoven, Netherlands

[73] Assignee: U.S. Philips Corporation, New York, N.Y.

[21] Appl. No.: 09/008,341

[22] Filed: Jan. 16, 1998

[30] Foreign Application Priority Data

Jan. 20, 1997 [EP] European Pat. Off. ..... 97200159

[51] Int. Cl.[6] ..... H01J 31/00

[52] U.S. Cl. ..... 313/422; 313/51

[58] Field of Search ..... 313/422, 495, 313/496, 497, 51, 583, 582

[56] References Cited

U.S. PATENT DOCUMENTS 5,313,136 5/1994 Van Gorkon et al. ..... 313/422

5,557,296 9/1996 Lambert et al. ..... 313/422

*Primary Examiner*—Ashok Patel

*Attorney, Agent, or Firm*—Robert J. Kraus

[57] ABSTRACT

The display device includes a vacuum-tight envelope having a transparent front wall which is provided with a display screen. The display device comprises an internal selection structure (67) which is provided with holes and with a plurality of electrodes for addressing desired pixels on the display screen. The display device is provided with connection elements (71, 72) which each comprise a springy end portion (73, 74), which contacts an electrode (61, 62) on the selection structure (10), and which connection elements further comprise a feed-through portion (75, 76) to make an electric connection, through a wall of the envelope, between the electrodes (61, 62) and a voltage source situated outside the envelope. Preferably, the springy end portion (73, 74) includes a material which retains its springiness up to temperatures of at least 450° C. for example a spring steel, and the material of the feed-through portion (75, 76) is adapted to the expansion of the material of the envelope. Preferably, the plates (60, 60', 60") of the selection structure (67) are displaced relative to each other in such a manner that the plates (60, 60', 60") do not overlap at locations where the springy end portions (73, 74) of the connection elements (71, 72) contact the electrodes (61, 62). During mounting, the connection elements (71, 72) are coupled to each other via a strip (85).

9 Claims, 4 Drawing Sheets

DISPLAY DEVICE, A CONNECTION ELEMENT FOR USE IN SAID DISPLAY DEVICE, AND A STRIP PROVIDED WITH SUCH CONNECTION ELEMENTS

BACKGROUND OF THE INVENTION

The invention relates to a display device having a vacuum-tight envelope comprising a transparent front wall which is provided with a display screen having a pattern of luminescent pixels, which display device comprises an internal selection structure which is provided with holes and with a plurality of electrodes for addressing desired pixels.

The invention also relates to a connection element comprising a springy end portion and a feed-through portion for use in a display device.

The invention also relates to a strip provided with a plurality of connection elements.

Display devices for displaying monochromatic or color images comprise, inter alia, (flat) cathode ray tubes (CRTs), plasma display panels (PDPs) and plasma-addressed liquid-crystal display devices (PALC displays).

A display device is known from U.S. Pat. No. 5,313,136. The display device (of the thin type) described in said document comprises a vacuum envelope having a transparent front wall an inner surface of which is provided with a display screen having a pattern of luminescent pixels, and said vacuum envelope further comprises a rear wall (which is connected to the front wall by side walls and/or partitions) which extends parallel to the front wall. The known display device comprises at least an electron source for generating electrons and addressing means for guiding said electrons to the display screen. The addressing means comprise a selection structure, which is composed of a stack of flat plates which are provided with coaxial apertures and on which a plurality of electrodes are provided for addressing the electrons. As soon as the electrons have passed through the selection structure, they are accelerated so as to provide the electrons with sufficient energy to excite the luminescent pixels, so that a high luminance is achieved.

A type of plasma display panels (PDP) comprises, in a vacuum envelope, a selection structure provided with holes and with row electrodes and column electrodes, which selection structure is situated between a rear wall provided with a plasma cathode and a front wall provided with a display screen having a pattern of luminescent pixels. In operation, a gas discharge is maintained between the plasma cathode and a (series of) row electrode(s), which serve(s) as the anode. A number of electrons from the gas discharge, which arrive at the anode, pass through the holes of the selection structure at a location where a row electrode and a column electrode cross each other. The current through the selection structure is determined by the voltage applied across the column electrode corresponding to the relevant row electrode. As soon as the electrons have passed through the selection structure, they are accelerated so as to provide the electrons with sufficient energy to excite the luminescent pixels, so that a high luminance is achieved.

In an alternative type of plasma display panels, a plasma is generated which plasma produces UV-light to address the relevant luminescent pixels by means of the selection structure.

A disadvantage of the known display device is that rejects occur during the manufacture thereof, which is undesirable.

SUMMARY OF THE INVENTION

It is an object of the invention to provide, inter alia, a display device in which the percentage of rejects is reduced.

To achieve this, the display device in accordance with the invention is characterized in that said display device is provided with connection elements, which each comprise a springy end portion, which contacts an electrode on the selection structure, and which connection elements further comprise a feed-through portion to make an electric connection, through a wall of the envelope, between the electrodes and a voltage source situated outside the envelope.

The invention is based on the recognition that it is desirable to make a construction for contacting the electrodes on the selection structure, the (electric) connection with the electrodes on the selection structure being made in the interior of the vacuum-tight envelope. In the known display device, the electric connections to the electrodes on the selection structure are made outside the vacuum-tight envelope, the selection structure being passed to the outside through a (side) wall of the vacuum-tight envelope. This applies, in particular, to selection structures composed of a number of plates.

For the purpose of connecting the electrodes on the selection structure in the vacuum-tight envelope to a voltage source situated outside the vacuum-tight envelope, the display device in accordance with the invention is provided with connection elements, which each comprise a springy end portion which electrically contacts an electrode on the selection structure, which connection elements further comprise a feed-through portion for passing the connection elements through a (side) wall of the envelope. The incorporation of springy end portions in the interior of the vacuum-tight envelope of the display device enables a simple and reliable (electric) connection to the electrodes on the selection structure to be achieved. These springy end portions can be provided on the selection structure before said selection structure is mounted in the display device. As, in addition, (the plates of) the selection structure do not have to be fed through (a side wall of) the vacuum-tight envelope, the selection structure itself does not form part of the (wall of the) vacuum-tight envelope. This means that the alignment of (the plates of) the selection structure relative to the pixels, which alignment must meet high accuracy requirements due to the presence of a plurality of holes for selectively passing the electrons or for selectively generating a plasma (pdp), is not (adversely) influenced during sealing the display device in a vacuum-tight manner (for example by means of fritting). In addition, as the selection structure is not situated partly inside the envelope and partly outside the envelope, a difference in pressure distribution on (the plates of) the selection structure is precluded in this manner. If the pressure inside the envelope differs from the pressure outside the envelope, this may give rise to an undesirable change in the position of (the plates of) the selection structure or a bend in the selection structure during sealing the envelope in a vacuum-tight manner. A bend in (a plate of) the selection structure may, in addition, give rise to a poor adhesion between an electrode and (the plate of) the selection structure, which may lead to rejects. Particularly in the case of large display devices (having a picture diameter, for example, of 100 cm) with large-scale selection structures, this increases the risk of rejects.

By virtue of the measure in accordance with the invention, the risk of rejects during the manufacture of the display device is reduced. An additional advantage is that the service life of the display device is increased by incorporating the (critical) (connection) elements in the interior of the display device. Oxidation of the electrodes and of the springy end portions is precluded by contacting the electrodes of the selection structure inside the vacuum-tight envelope.

An embodiment of the display device in accordance with the invention is characterized in that the springy end portion comprises a material which retains its springiness up to a temperature of at least 450° C. When the display device is sealed in a vacuum-tight manner, for example, using a so-called (glass) frit or vitreous enamel, in which process the (side) wall of the envelope is connected to the front wall and the rear wall of the display device, a temperature increase occurs in the display device. By composing the springy end portion of a material which retains its springiness up to approximately 450° C. the desired properties of the springy end portion are preserved during the manufacture of the display device, and rejects due to a poor contact between the springy end portion and the electrode on the selection structure is precluded. The springy end portion is preferably made of a material whose limit of elasticity remains so high, after a temperature treatment up to approximately 450° C. that the remaining springiness is sufficient to preserve the electric contact. Preferably, the springy end portion is made of a material whose modulus of elasticity is above $20.10^{10}$ Pa. A material which can particularly suitably be used for the springy end portion is a so-called spring steel, for example an alloy comprising iron, chromium, nickel and manganese, such as an iron alloy comprising 16–18% by weight of Cr, 6–9% by weight of Ni and ≦2% by weight of Mn (preferably ≦1.5% by weight of Si). Preferably, the feed-through portion comprises a material whose expansion is adapted to that of the material of the envelope. During sealing the display device in a vacuum-tight manner, for example by means of the provision of a so-called (glass) frit or vitreous enamel, in which process the (side) wall of the envelope is connected to the front wall and the rear wall of the display device, it is desirable that the coefficient of expansion of the feed-through portion of the connection element should be adapted to the coefficient of expansion of the (glass) frit or the vitreous enamel. By virtue thereof, a good vacuum-tight envelope is obtained. Preferably, the material used for the feed-through portion is a so-called expansion alloy. The material of the envelope influences the choice of the material used for the feed-through portion. If the material used for the envelope comprises borosilicate glass at the location of the feed-through, then an iron-nickel-cobalt alloy (a so-called "fernico-steel" for fusion-sealing of glass) can suitably be used as the material for the feed-through portion. In the case of borosilicate glass, a material which can very suitably be used for fusion-sealing of glass is a material having a linear coefficient of expansion in the range from 5.8 to $6.2 \cdot 10^{-6}$ $K^{-1}$, for example an iron alloy comprising 28% by weight of Ni and 18% by weight of Co. If the material of the envelope comprises soda-lime glass at the location of the feed-through, then an iron-nickel-chromium alloy can suitably be used as the material for the feed-through portion. A particularly suitable material for fusion-sealing of glass is a material having a linear coefficient of expansion in the range from 9 to $10 \cdot 10^{-6}$ $K^{-1}$, for example an iron alloy comprising 47% by weight of Ni and 5% by weight of Co.

An embodiment of the display device in accordance with the invention is characterized in that the connection elements comprise, outside the envelope, a further end portion of a material which reduces oxidation of the further end portion during a thermal treatment at temperatures up to at least 450° C. under atmospheric conditions. During sealing the display device in a vacuum-tight manner, a temperature increase occurs in the display device. By making the further end portion of a material which oxidizes partly, or perhaps not at all, up to temperatures of approximately 450° C. the further end portion makes a satisfactory electric contact if said further end portion is connected to the voltage source. Preferably, said further end portion is made of the same material as the feed-through portion. To protect the further end portion from oxidation, the material used for said further end portion may also comprise (other) poorly oxidizing or refined metals. The further end portion may also be provided with an oxidation-reducing material, for example a gold layer. In accordance with another solution, the feed-through portion and/or the further end portion is/are surrounded by a protective gas when the temperature increases during sealing the display device in a vacuum-tight manner. By virtue of the measures in accordance with the invention, the risk of rejects during the manufacture of the display device is reduced.

These and other aspects of the invention will be apparent from and elucidated with reference to the embodiments described hereinafter.

BRIEF DESCRIPTION OF THE DRAWING

In the drawing.

The Figures are purely schematic and not drawn to scale. In particular for clarity, some dimensions are exaggerated strongly. In the Figures, like reference numerals refer to like parts, whenever possible.

DESCRIPTION OF THE PREFERRED EMBODIMENTS

Figure 1A:
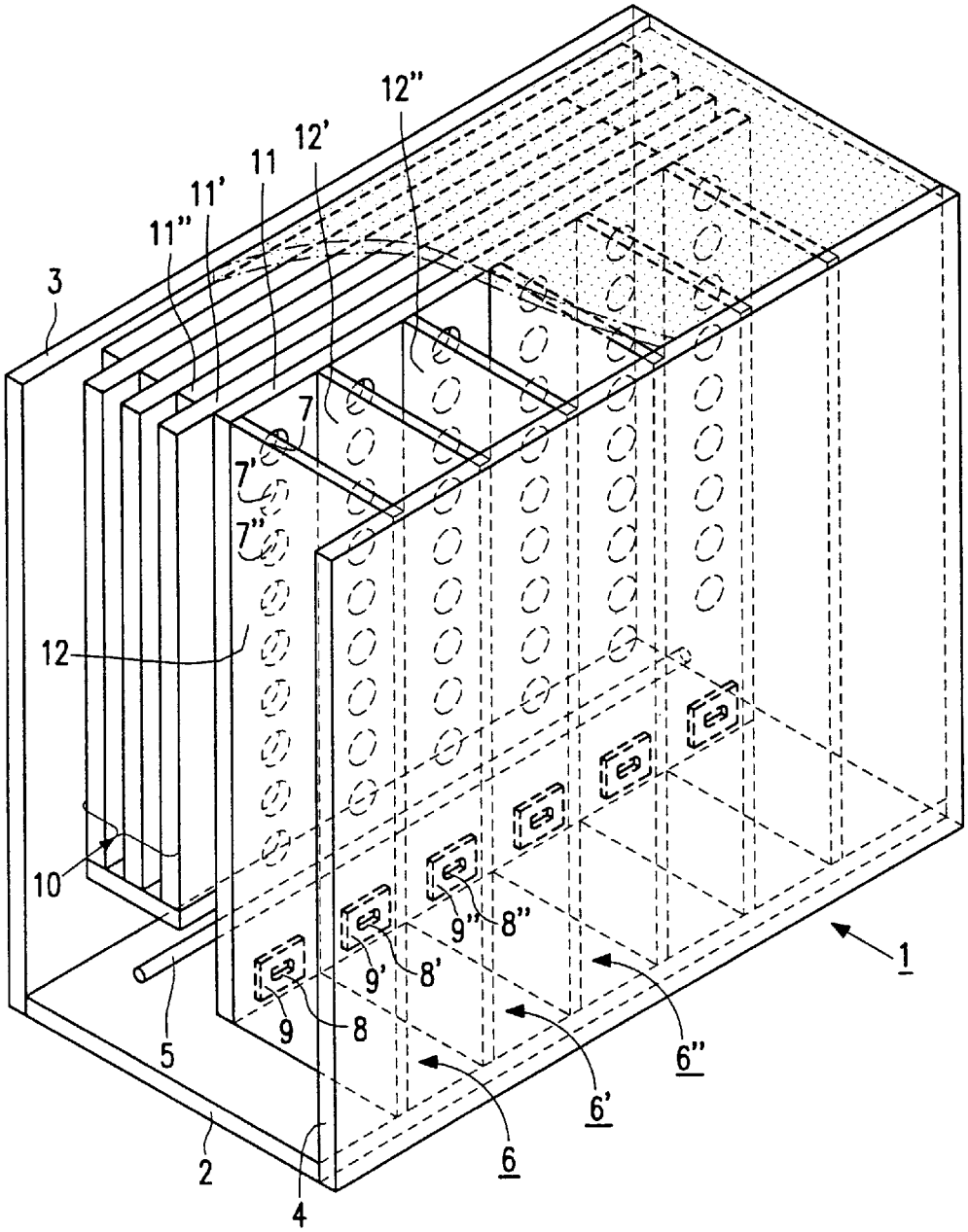
FIG. 1A is a schematic, perspective view, partly cut away, of a part of a construction of a display device (flat CRT)

FIG. 1A is a very schematic, perspective view, partly cut away, of an example of a construction of a display device 1 (flat CRT), which is provided with a selection structure in accordance with the invention. In this example, the selection structure comprises a stack of flat plates. The invention is important, in particular, for this type of flat display devices. The display device comprises a front wall (window) 3 and an opposing rear wall 4, which extends parallel to said front wall 3. On the inner surface of the front wall 3, there is provided a display screen which comprises a (regular) pattern of pixels luminescing, respectively, in red, green and blue (not shown in FIG. 1A). Near an upright (side) wall 2, which connects the front wall 3 and the rear wall 4 to each other, there is arranged, at least, an electron source 5. This electron source 5 comprises, for example, a cathode arrangement comprising one or more line cathodes or a large number of separate electrodes. A number of electron-propagation means, which cooperate with the electron source 5, are arranged next to said electron sources, which electron-propagation means are formed by ducts 6, 6', 6" etc., which are separated from the electron-propagation means by walls 12, 12', 12" etc., which extend at right angles to the rear wall 4 so as to form the ducts of a so-called duct structure. The electron-propagation means cooperate, via a so-called cathode plate having (entrance) apertures 8, 8', 8", etc., and electrodes 9, 9', 9", etc., with the electron source 5 and extend substantially parallel to the front wall. In the example of FIG. 1A, the apertures 8, 8', 8", etc., are rectangular. In alternative embodiments, the apertures 8, 8', 8", etc., are square, round, oval or of any other shape. In a further alternative embodiment of the display device 1, the electron source 5 is arranged in the extension of (i.e. below) the duct structure. A selection structure, which closes the ducts 6, 6', 6", etc., is provided with holes 7, 7', 7", etc., to selectively pass the electrons. In this example, the selection structure 10 comprises a stack of a number of (flat) plates 11, 11', 11", etc., provided with holes 7, 7', 7", etc. The plates 11, 11', 11", etc., of the selection structure 10 have been displaced relative to each other and provided with electrodes (not shown in FIG. 1A) to address desired pixels.

Figure 1B:
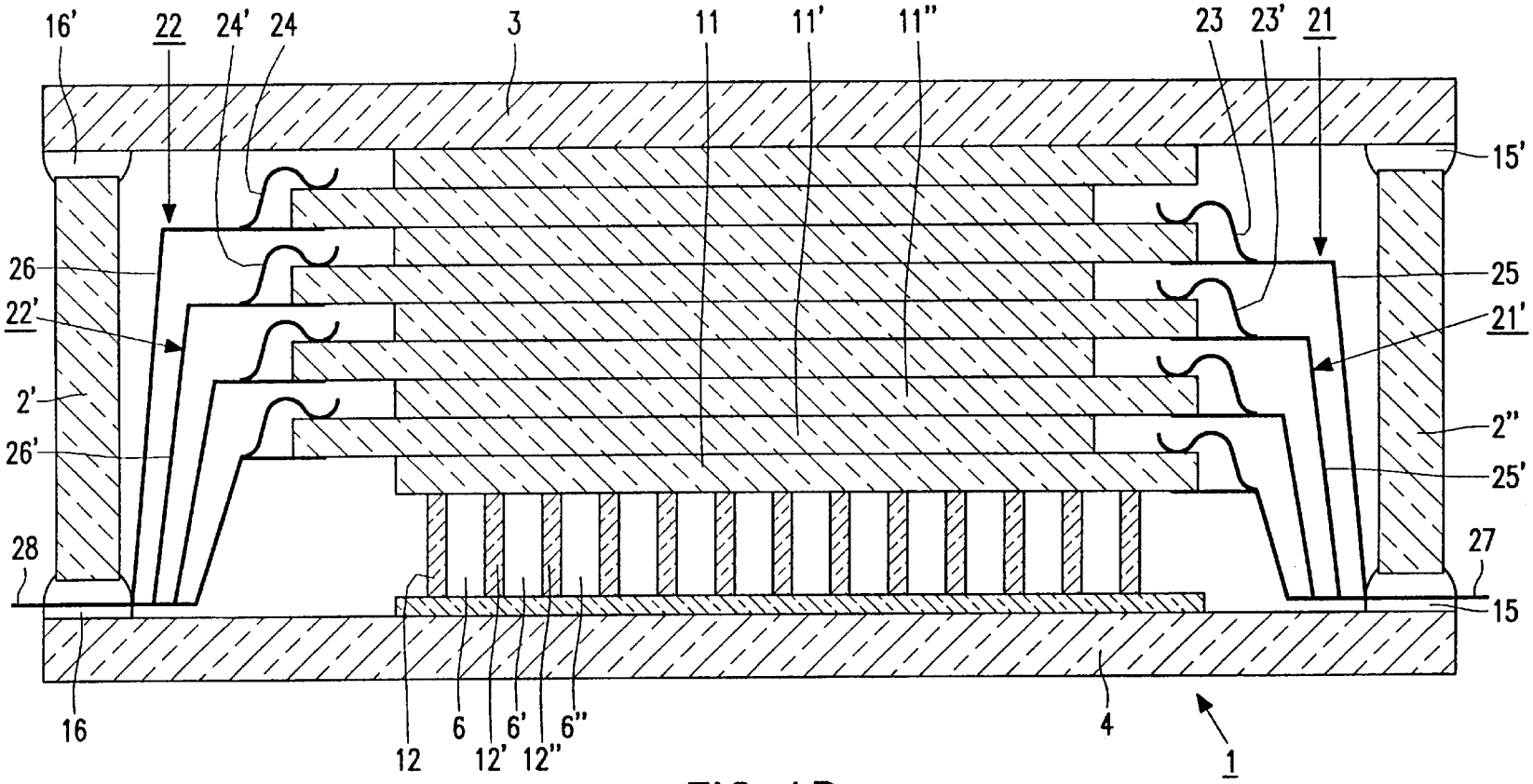
FIG. 1B schematically shows, in cross-section, a plan view of the display device shown in FIG. 1A.

FIG. 1B very schematically shows, in cross-section, a plan view of the display device 1 shown in FIG. 1A. Side walls 2'; 2" connect the front wall 3 to the rear wall 4 by means of so-called glass frits or vitreous enamels 15, 15'; 16, 16", so that a vacuum-tight envelope is formed. The side walls 2'; 2" may alternatively form part of the rear wall 4 or the front wall 3. The walls 12, 12', 12" etc., separate the ducts 6, 6', 6" etc., from each other, which ducts form the electron-propagation means (the electron source is not shown in FIG. 1B). FIG. 1B shows connection elements 21, 21'; 22, 22" in accordance with the invention, which electrically connect the electrodes on the plates 11, 11', 11", etc., of the selection structure to a voltage source (not shown in FIG. 1B) which is situated outside the envelope. At the location of the plates 11, 11', 11", etc., the connection elements 21, 21'; 22, 22" comprise springy end portions 23, 23'; 24, 24", which contact an electrode on the selection structure. The connection elements 21, 21'; 22, 22" further comprise feed-through portions 25, 25'; 26, 26", which bring about an electric connection between the selection structure and the voltage source via a glass frit or a vitreous enamel 15; 16. Outside the envelope, the connection elements 21, 21'; 22, 22" comprise further end portions 27; 28 for making electric connections to the voltage source. To simplify the connection to the voltage source, these further end portions 27; 28 may also comprise a further springy end portion. To preclude oxidation of the connection elements during the manufacture of the display device (for example during sealing in a vacuum-tight manner), parts of said connection elements may be made of an oxidation-reducing material (for example a poorly oxidizing or refined metal) or be provided with an oxidation-reducing coating, for example a gold layer. It is alternatively possible to surround the display device with a protective-gas atmosphere.

In the example of the display device of the thin type shown in FIGS. 1A and 1B, the selection structure comprises a plurality of stacked, flat plates 11, 11', 11" etc., which are provided with electrodes. These plates are displaced relative to each other in such a manner that they do not overlap at locations where the springy end portions 23, 23'; 24, 24' of the connection elements 21, 21'; 22, 22' contact the electrodes on the plates of the selection structure. The advantage of such a displacement is that the plates of the selection structure have the same dimensions, which simplifies the manufacture of the selection structure.

Figure 2:
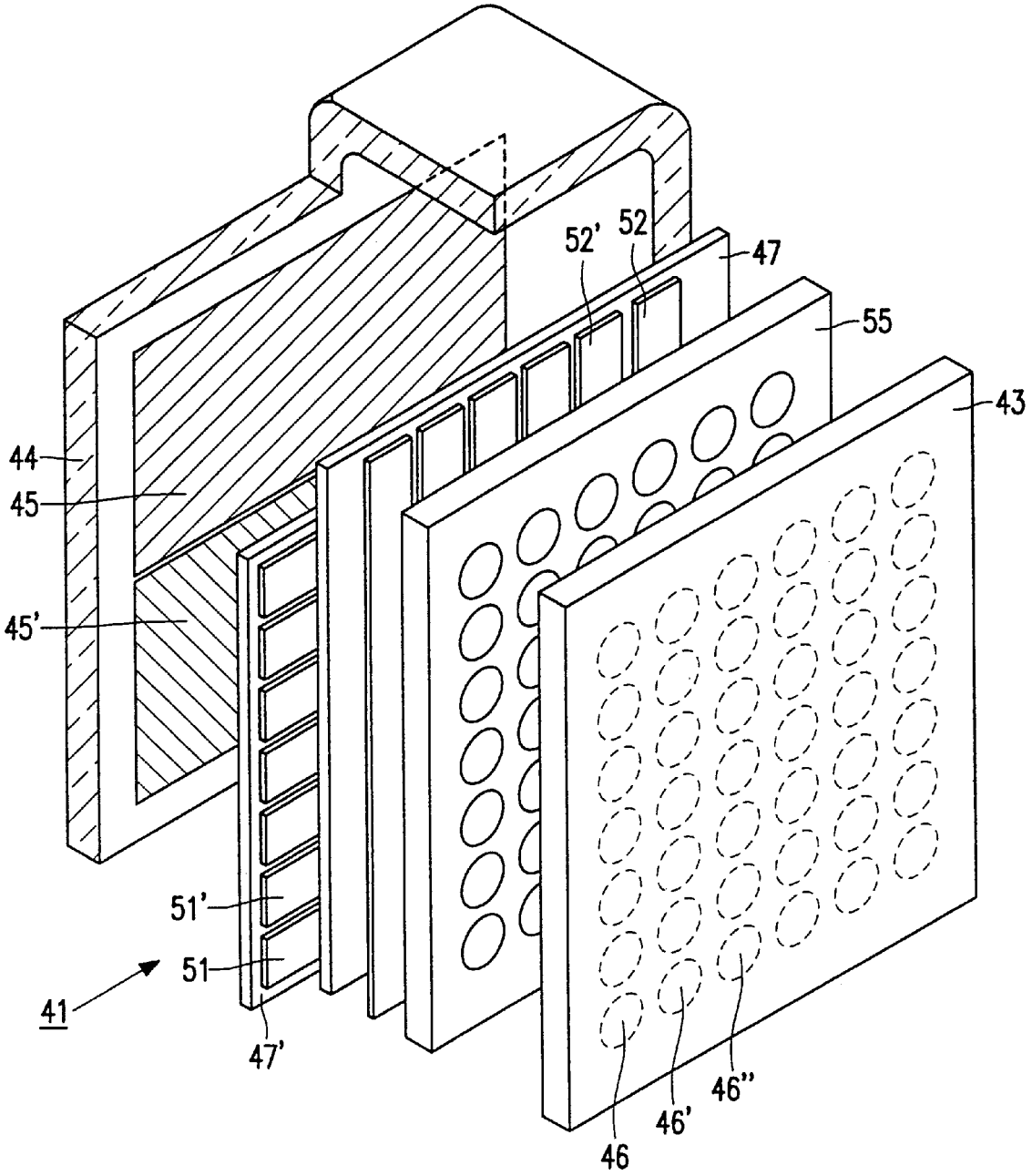
FIG. 2 is a schematic, perspective view, partly cut away, of a part of an alternative construction of a display device of the thin type (plasma display panel)

FIG. 2 is a very schematic, perspective view, partly cut away, of a part of an alternative construction of a display device. This display device of the thin type is a so-called plasma display panel (PDP). The plasma display panel 41 comprises, in a vacuum envelope, a selection structure 47; 47' provided with holes (not shown in FIG. 2) and with row electrodes and column electrodes 51, 51'; 52, 52', which selection structure is arranged between a rear wall 44 provided with one or more plasma cathodes 45, 45' and a front wall 43 provided with a display screen having a pattern of luminescent pixels 46, 46', 46", etc. In this example, the selection structure comprises a stack of two plates 47, 47'. In operation, a gas discharge is maintained between the plasma cathode 45, 45' and a (series of) row electrode(s) 51, 51', which serve(s) as the anode. A number of electrons from the gas discharge, which arrive at the anode, pass through the holes in the (plates of the) selection structure 47; 47' at the location where a row electrode and a column electrode cross each other. The current through the selection structure 47; 47' is determined by the voltage applied across the column electrodes 52, 52' corresponding to the relevant row electrode. As soon as the electrons have passed through the selection structure 47; 47', they are accelerated in a so-called fluorescent spacer 55 so as to provide the electrons with sufficient energy to excite the luminescent pixels 46, 46', 46" etc. Connection elements in accordance with the invention (not shown in FIG. 2) connect the electrodes 51, 51'; 52, 52' on the plates of the selection structure 47; 47' to a voltage source (not shown in FIG. 2) which is situated outside the envelope.

In an alternative embodiment, the plasma generates UV-light which exits the holes of the selection structure 47; 47', which UV-light addresses the relevant luminescent pixels 46, 46', 46", etc., of the display screen on the frontwall 43 of the plasma display panel.

Figure 3:
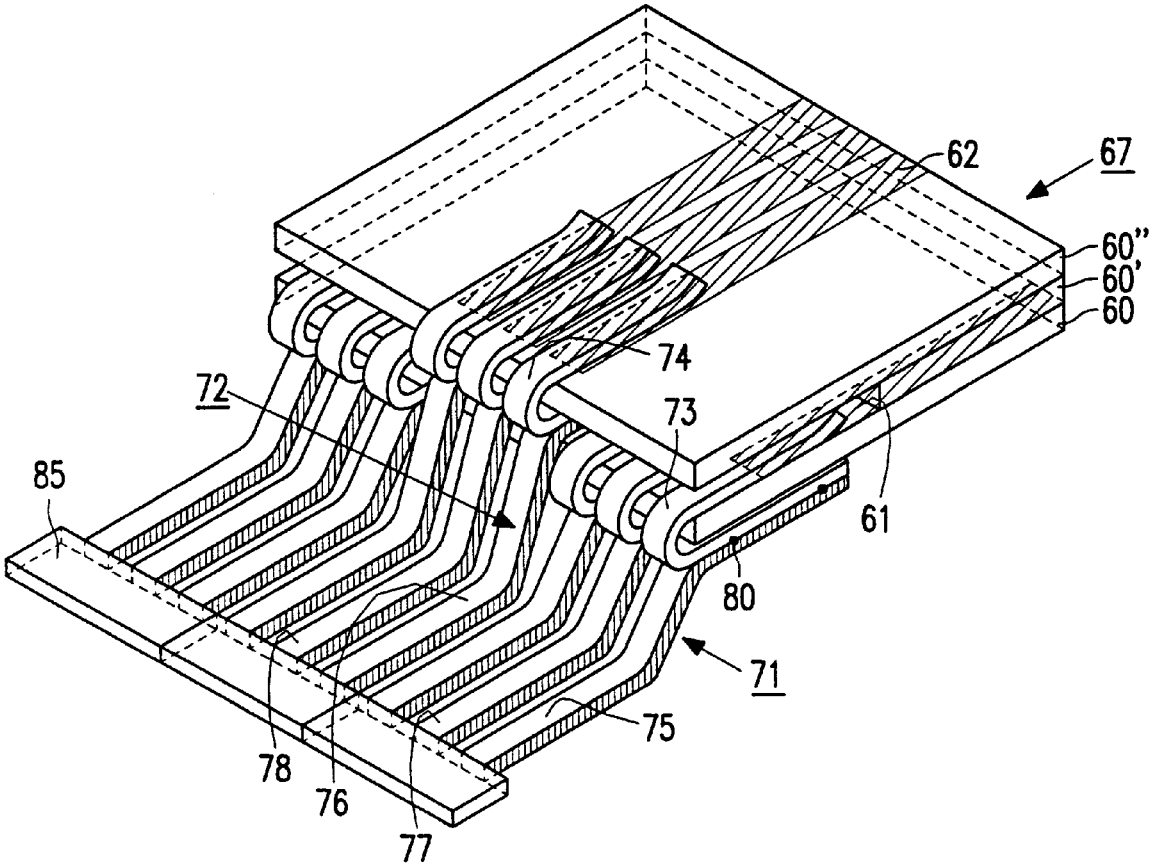
FIG. 3 is a schematic, perspective view of a part of a selection structure provided with connection elements in accordance with the invention.

FIG. 3 is a schematic, perspective view of a part of a selection structure 67 provided with connection elements 71, 72 in accordance with the invention. The connection elements 71; 72 electrically connect the electrodes on the plates 60; 60" of the selection structure 67 to a voltage source (not shown in FIG. 3) outside the envelope. Plates 60' are contacted on the other side of the selection structure (not shown in FIG. 3). On the plates 60, 60', 60", etc., the connection elements 71; 72 comprise springy end portions 73; 74 which contact an electrode 61; 62 on the selection structure 67. The connection elements 71; 72 further comprise feed-through portions 75; 76 which electrically connect the selection structure 67 to the voltage source through a side wall (not shown in FIG. 3) of the envelope. The springy end portions 73, 74 and the feed-through portions 75, 76 are connected to each other, for example by means of a welded joint 80. This is the case, notably, if the materials of the springy end portions 73, 74 and of the feed-through portions 75, 76 are different. The requirements to be met by the materials of the connection elements 71; 72 generally are different. The springy end portions 73, 74 retain their springiness up to temperatures of at least substantially 50° C. while the expansion of the material of the feed-through portions 75, 76 is adapted to the expansion of the glass and the glass frit or vitreous enamel. Outside the envelope, the connection elements 71; 72 comprise further end portions 77; 78 for making electric connections to the voltage source, which further end portions 77; 78 may be made of or provided with an oxidation-reducing material or coating.

In the example shown in FIG. 3, the selection structure 67 comprises a plurality of stacked flat plates 60, 60', 60", etc., which are provided with electrodes 61; 62. These plates are displaced relative to each other in such a manner that they do not overlap at locations where the springy end portions 73; 74 of the connection elements 71; 72 contact the electrodes on the plates of the selection structure 67.

During mounting of the connection elements, a plurality of connection elements are interconnected via a strip 85. Customarily, separate plates of the selection structure have their own strip with connection elements. Preferably, (see FIG. 3), the strip 85 is situated on the side of the further end portions 77; 78 of the connection elements 71; 72. After mounting of the connection elements 71; 72, this strip 85 is removed.

It will be obvious that within the scope of the invention many variations are possible to those skilled in the art.

In general, the invention relates to a display device comprising a vacuum-tight envelope having a transparent front wall provided with a display screen and a rear wall which extends parallel to said front wall. The display device comprises an internal selection structure which is provided with holes and with a plurality of electrodes for addressing desired pixels on the display screen. The display device is provided with connection elements which each comprise a springy end portion, which contacts an electrode on the selection structure, and which connection elements further comprise a feed-through portion for making an electric connection, through a wall of the envelope, between the electrodes and a voltage source situated outside the envelope. Preferably, the springy end portion comprises a material which retains its springiness up to temperatures of at least 450° C. for example a spring steel, and the material of the feed-through portion is adapted to the expansion of the material of the envelope. Preferably, the plates of the selection structure are displaced relative to each other in such a manner that the plates do not overlap at locations where the springy end portions of the connection elements contact the electrodes. During mounting, the connection elements are coupled to each other via a strip.

We claim:

1. A display device having a vacuum-tight envelope comprising a transparent front wall which is provided with a display screen having a pattern of luminescent pixels, which display device comprises an internal selection structure which is provided with holes and with a plurality of electrodes for addressing desired pixels, characterized in that said display device is provided with connection elements, each comprising a springy end portion, for contacting one of said electrodes, and which connection elements further comprise a feed-through portion to make an electric connection, through a wall of the envelope, between the electrodes and a voltage source situated outside the envelope.

2. A display device as claimed in claim 1, characterized in that the springy end portion comprises a material which retains its springiness up to temperatures of at least 450° C.

3. A display device as claimed in claim 2, characterized in that the material of the springy end portion comprises a spring steel.

4. A display device as claimed in claim 1, characterized in that the feed-through portion comprises a material having a coefficient of expansion which is adapted to that of the material of the envelope.

5. A display device as claimed in claim 1, characterized in that the connection elements comprise, outside the envelope, a further end portion of a material which reduces oxidation of the further end portion during a thermal treatment at temperatures up to at least 450° C. under atmospheric conditions.

6. A display device as claimed in claim 1, characterized in that the selection structure comprises a plurality of stacked flat plates provided with electrodes, which plates are displaced relative to each other in such a manner that the plates do not overlap at locations where the springy end portions of the connection elements contact the electrodes.

7. A display device as claimed in claim 6, characterized in that the flat plates are provided, on alternate sides, with connection elements.

8. A connection element comprising a springy end portion and a feed-through portion for use in a display device having a vacuum-tight envelope comprising a transparent front wall which is provided with a display screen having a pattern of luminescent pixels, said display device comprising an internal selection structure which is provided with holes and with a plurality of electrodes for addressing desired pixels, said connection element being provided for contacting one of said electrodes with said springy end portion.

9. A strip which is provided with a plurality of connection elements, each comprising a springy end and a feed-through, for use in a display device having a vacuum-tight envelope comprising a transparent front wall which is provided with a display screen having a pattern of luminescent pixels, said display device comprising an internal selection structure which is provided with holes and with a plurality of electrodes for addressing desired pixels, said connection elements each being provided for contacting one of said electrodes with said springy end portion.

* * * * *